US005335587A

United States Patent [19]

Stoll

[11] Patent Number: 5,335,587

[45] Date of Patent: Aug. 9, 1994

[54] HOUSING FOR A DRIVE CYLINDER

[75] Inventor: Kurt Stoll, Esslingen, Fed. Rep. of Germany

[73] Assignee: Festo KG, Bundesrepublik, Fed. Rep. of Germany

[21] Appl. No.: 63,415

[22] Filed: May 19, 1993

[30] Foreign Application Priority Data

Jun. 4, 1992 [DE] Fed. Rep. of Germany ... 9207582[U]

[51] Int. Cl.[5] ..... F01B 11/02

[52] U.S. Cl. ..... 92/169.2; 92/171.1; 92/5 R; 29/888.061

[58] Field of Search ..... 92/169.1, 169.2, 169.3, 92/169.4, 171.1, 5 R, 248; 29/888.06, 888.061

[56] References Cited

U.S. PATENT DOCUMENTS

| | | | |
|---|---|---|---|
| 4,162,616 | 7/1979 | Hayashida | 92/171.1 |
| 4,207,807 | 6/1980 | Takata et al. . | |
| 4,856,416 | 8/1989 | Nix et al. | 92/169.1 |
| 4,867,044 | 9/1989 | Holtrop | 92/171.1 |
| 4,872,396 | 10/1989 | Wimbush | 92/169.1 |
| 4,884,493 | 12/1989 | Tootle . | |
| 4,896,584 | 1/1990 | Stoll | 92/5 R |
| 4,971,846 | 11/1990 | Lundy . | |

FOREIGN PATENT DOCUMENTS

| | | | |
|---|---|---|---|
| 0176212 | 8/1985 | European Pat. Off. . | |
| 0384948 | 6/1989 | European Pat. Off. . | |
| 8204795 | 2/1982 | Fed. Rep. of Germany . | |
| 0126701 | 5/1919 | United Kingdom | 92/171.1 |
| 2078335 | 1/1982 | United Kingdom | 92/169.1 |
| 2203215 | 6/1987 | United Kingdom . | |

*Primary Examiner*—Thomas E. Denion
*Attorney, Agent, or Firm*—Browdy and Neimark

[57] ABSTRACT

A housing for a drive cylinder which comprises an inner tube and an outer tube. The inner tube is a metal tube and is encircled by the outer tube consisting of synthetic resin material coaxially. In this manner it is possible to ensure a highly accurate cross section for the inner surface swept by the piston during operation. Simultaneously there is a large amount of freedom as regards any desired particular configuration of the external surface of the cylinder barrel.

13 Claims, 1 Drawing Sheet

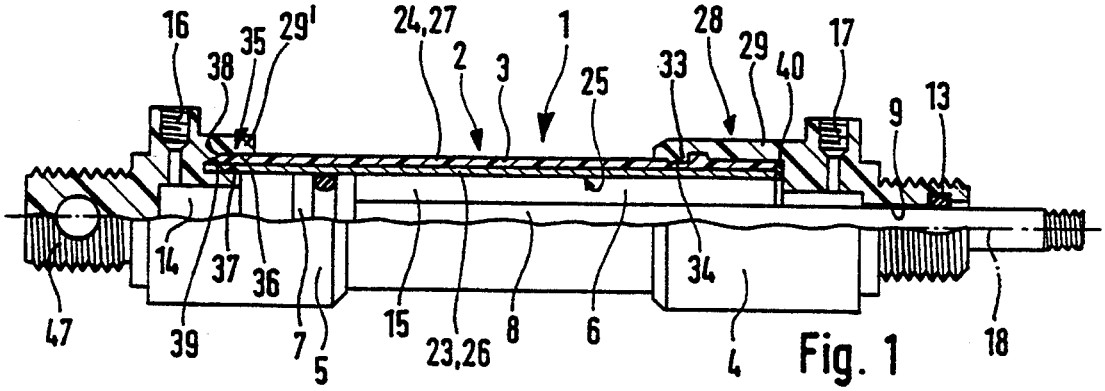
Fig. 1
Fig. 2
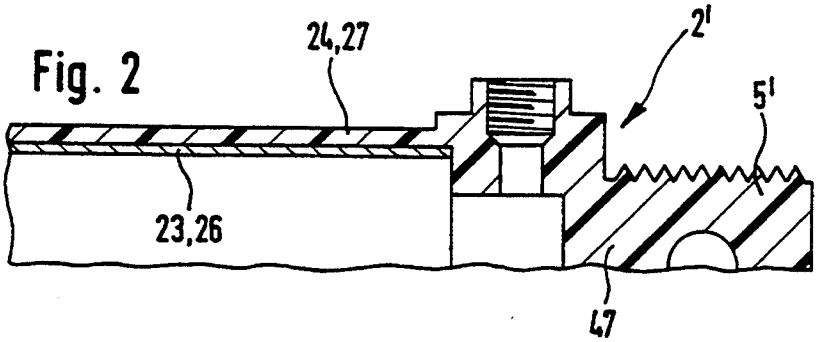
Fig. 3
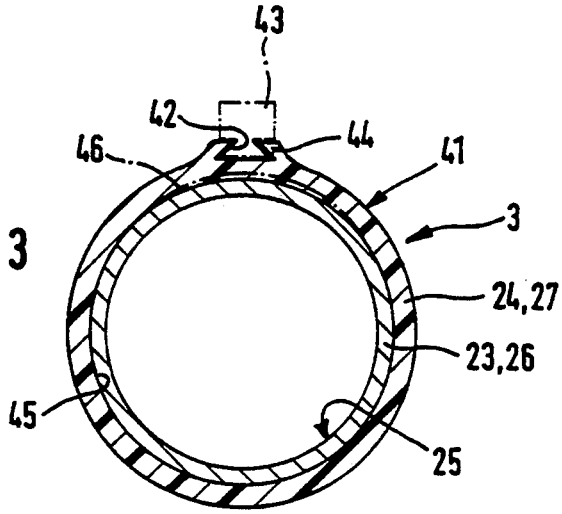

HOUSING FOR A DRIVE CYLINDER

BACKGROUND OF THE INVENTION

The present invention relates to a housing for a drive cylinder comprising a cylinder barrel which is made up of an inner tube and a coaxially arranged outer tube in direct radial, external contact with the inner tube, which it firmly encircles.

Such a housing has been proposed, see for example the German utility model G 8,204,795. In order to achieve low friction properties the inner tube in this case consists of synthetic resin material and in order to improve impact strength has a surrounding outer tube of metal. The selected tube combination furthermore renders possible a relatively small wall thickness, this leading in turn to a reduction in weight. However problems have occurred in connection with producing a permanent, high quality inner surface on the barrel, along which the piston slides during operation. It is difficult to ensure smooth running on such inner surface within tolerable limits. Furthermore wear of the synthetic resin tube is responsible for problems and in the course of time will lead to leaks through the contact zone between the piston and the cylinder bore. Finally there are very exacting requirements as regards the accuracy of manufacture of the metal tube, since the inserted synthetic resin tube makes close contact with the bore of the outer tube and practically assumes the form thereof. Therefore among the difficulties involved there is a difficulty with the attachment of sensors, functioning to detect the position of the piston, on the outer periphery of relatively thin metal tubes so that measures taken to permit such attachment have an unfavorable effect on the accuracy of the outline or cross section of the barrel.

SHORT SUMMARY OF THE INVENTION

Accordingly one object of the present invention is to provide a housing of the type initially mentioned, that while maintaining a very low wall thickness and rendering possible great variation in the form of the outer periphery, ensures a high resistance to wear and a dimensional accuracy along the stroke of the piston.

In order to attain these and/or other objects appearing from the following description, the inner tube is a metal tube and the outer tube is a synthetic resin tube of non-reinforced synthetic resin material.

In this manner the invention provides a bore or inner surface of the cylindrical barrel, which is contacted by the piston as it performs a stroke, having an extremely wear-resistant and dimensionally exact material, which as regards the surface roughness can be kept within the necessary limits. The metal tube constituting the bore or inner surface is furthermore essentially responsible for the strength of the housing. For the encircling outer tube it is accordingly possible to utilize a synthetic resin material with lower strength properties, more particularly because it is not subjected to any dynamic load and consequently there are no excessively exacting requirements as regards resistance to abrasion. Nevertheless the use of synthetic resin material for the outer tube makes possible variations in the configuration of the outer periphery with little complexity so that for example it is possible to provide mounting grooves for sensor without any difficulties. In combination with the lower wall thickness now possible this latter feature means that the position of the piston may be very accurately detected by the sensor, the piston in this case having a permanent magnet, whose magnetic field extends outwards through the wall of the cylinder barrel and is able to actuate a sensor responsive to the magnetic field.

Although a suggestion has already been made to produce the entire cylinder barrel of synthetic resin material, see in this respect the German patent publication 3,020,390 C2, in this case it is essential to keep to a uniform cylinder wall thickness over its entire periphery, since any structure molded thereon would entail a lack of dimensional accuracy of the bore, with which the piston is in direct cooperation. In the case of the design in accordance with the invention there is no such impairment.

Further advantageous forms of the invention are recited in the claims.

In accordance with a further advantageous development of the invention the inner and/or the outer tube of the cylinder barrel are in the form of extruded structures, this meaning that it is a simple matter to produce any desired cross section.

Furthermore it is possible for the housing to have cylinder end caps arranged at the ends of the cylinder barrel and which completely consist of synthetic resin material, in the case of which it may also be a question of non-reinforced synthetic resin material. The connection with the cylinder barrel is in this case directly between the cylinder cap and the outer tube, and in addition to a snap-on or detente connection or a weld it is possible for at least one cylinder end cap to be made integrally with the outer tube. The result is then a housing with a very small number of components and furthermore any necessary attachment part for mounting the housing can be directly molded on a cylinder cap consisting of synthetic resin material.

Further advantageous developments and convenient forms of the invention will be understood from the following detailed descriptive disclosure of two embodiments thereof in conjunction with the accompanying drawings.

LIST OF THE SEVERAL VIEWS OF THE FIGURES

FIG. 1 shows a first design of the housing in accordance with the invention in side elevation, the part which is above the center line, being broken away as a longitudinal section, the housing being a component of a finished drive cylinder having a piston and a piston rod running therein.

FIG. 2 shows part of the end part, which bears the cylinder end cap, of a further possible design of the housing, in longitudinal section.

FIG. 3 shows a further possible working embodiment of a housing in cross section, a sensor mounted in an attachment groove being shown in broken lines which functions to detect the position of the piston.

DETAILED ACCOUNT OF WORKING EMBODIMENTS OF THE INVENTION

In FIG. 1 a drive cylinder 1 is illustrated which is more particularly in the form of a pneumatically operated piston and cylinder unit having a first possible configuration of the housing 2. The housing comprises a cylinder barrel 3 with, for example, a circular cross section and which is closed off at both ends by a respective cylinder cap 4 and 5. The space 6 within the housing delimited by the two cylinder caps 4 and 5 and by the cylinder barrel 3 is able to accept an axially moving piston 7, which for instance is provided with a piston rod 8. The latter extends from the piston 7 coaxially through the space 6 within the housing towards one of the cylinder caps 5, which has an opening 9 for the piston rod 9 to pass through to the outside. In order to guide and/or seal off the piston rod 8 where it extends through the opening 9 the same preferably has a diagrammatically indicated guide and/or sealing arrangement 13.

In principle it would be possible to have a continuous piston rod 8 extending right through the cylinder, that is to say through the second cylinder cap 5 like the first cylinder cap 4. For instance it is however possible for the one (14) working space of the two spaces 14 and 15, which are separated from one another in the housing space 6 by the piston 7, to be free of any piston rod so that the associated cylinder cad 5 has a continuous wall with a connection port 16. The said connection port 16 opens into the working space 14, as is also the case with a connection port 17 in the first cylinder cap 4 as regards the working space 15. The connection ports 16 and 17 render possible the connection of suitable connecting lines in order to supply and let off fluid power medium and therefore to reciprocate the piston 7 with its piston rod 8 along the longitudinal axis 18 of the housing.

The cylinder barrel 3 is made up of two tube elements, that is to say an inner tube 23 and an outer tube 24 directly encircling and contacting it along its outer surface. The outer tube 24 the inner tube 23 are accordingly coaxially arranged in relation to one another around the longitudinal axis 18 of housing 2.

The inner tube 23 consists of metal with a high resistance to abrasion, stainless steel being utilized in the working embodiment. This material furthermore renders possible the use of tubing with very thin walls without disadvantages as regards strength. The metal tube 26 employed in the present case can be produced in a relatively simple manner with a high dimensional accuracy and within very low tolerances; furthermore the bore surface 25 swept by the piston 7 during its motion may be extremely accurately machined and provided with a very small surface roughness so that free running of the piston 7 with little wear is ensured. The inner tube 23 constituting the metal tube 26 is preferably a piece of extruded stock cut off to the right length, which may be produced with the desired cross section by suitable drawing technology directly during manufacture. In case of need it is however perfectly simple to perform precision finishing operations on the bore surface 25, for example by honing.

In the case of the illustrated working embodiment the inner tube 23 has the outer tube 24 encircling it for its full length, and preferably the two tubes are of equal length so that their ends are in alignment. In the case of the outer tube 24 it is a question of synthetic resin tube 27, which preferably consists of non-reinforced synthetic resin material, which is relatively low in price. Reinforcement is unnecessary, since the strength of the cylinder barrel 3 is significantly dependent on the that of the metal tube 26. Nevertheless the outer tube 24 as well will be considered to make a contribution to the strength of the structure in order to keep the overall wall thickness of the cylinder barrel 3 to a minimum. In the case of the outer tube 24 as well it is a preferably question of extruded material cut to the required length, in which respect however the dimensional accuracy specifications may be less exacting because it does not have to perform any guiding function for the piston 7. In a normal case the proportion of the overall wall thickness due to the cylinder tube 3 will be greater than the contribution due to the metal inner tube 23.

The design is such that the outer tube 24 and the inner tube 23 are in direct contact with one another over their adjacent peripheral surfaces. Even without auxiliary means the two tubes 23 and 24 are secured in relation to each other both in the circumferential direction and also in the axial direction. This is achieved for example by using measures which entail a radial clamping effect between the two tubes 23 and 24 placed one inside the other.

In order to achieve this it is possible for the inner tube 23 and the outer tube 24 in principle to be force fitted inside each other by axial insertion. Preferably the relative locking action is however produced by a so-called shrink fit, this being the case for example with the working embodiment. Here the outer tube 24 and the inner tube 23 are at the start separate from each other, the inner diameter of the synthetic resin tube 27, which is provided as the outer tube 24, being somewhat less than the outer diameter of the metal tube provided as the inner tube. The next step is for the synthetic resin tube to be heated until there is the degree of expansion required for introduction of the metal tube 26 without any difficulty. In this case overall inaccuracies between the outer surface of the metal tube 26 and the inner surface of the synthetic resin tube 27 with a height of up to approximately 0.5 mm will be spanned. In this respect the synthetic resin material of the synthetic resin tube 27 may be polyoxymethylene (POM) which when heated to approximately 160° C. may be expanded by approximately 0.6 mm in diameter, the rated diameter of the cylinder tube being between 32 and 40 mm so that assembly is possible without any trouble. Owing to the improved dimensional accuracy in the case of other synthetic resin materials it is possible for the inaccuracies to be bridged over to be less. This is for example possible with an outer tube manufactured of polyvinyl chloride (PVC). At any rate the inner tube 23 is firmly gripped by the encircling outer tube 24, which has been slipped onto it, after cooling down.

In principle it would furthermore be possible to extrude a metal tube 26 and a synthetic resin tube 27 in such a manner that both tubes would be directly extruded one on top of the other. As a result of such coaxial extrusion operation there would be a tube in tube strand with an outer synthetic resin tube and a metal inner tube, which would only have to be cut off to the required lengths of the cylinder barrel 3.

In order to save weight it is a great advantage if at least one of the cylinder caps 4 and 5 fitted also consists of synthetic resin. For instance in the case of both the cylinder caps 4 and 5 it is a question of synthetic resin components of, more particularly, non-reinforced synthetic resin material. The latter synthetic resin is preferably the same as that utilized for the associated outer tube 24. In order to not to utilize any complicated measures for connection which would increase the overall width and/or weight, it is in this respect an advantage if the connection between each cylinder cap 4 and 5 and the cylinder barrel 3 is a permanent connection, as is in fact the case with the illustrated working embodiment.

Between the cylinder cad 4 arranged on the right in FIG. 1 and the cylinder barrel 3 there is a snap-on or detente connection 28. A tubular projecting part of the cylinder cap 4 is coaxially arranged on the outer tube 24 and its inwardly extending detente projection 33, which more particularly is circumferential, snaps into a complementary circumferential groove 34 in the outer tube 24. As an alternative or in addition to this it is possible additionally for an annular projection, which extends radially outwards, on the outer tube 24 to fit into a corresponding detente depression in the internal periphery of the projection 29. Once it has snapped into place, the detente connection 28 may not be released without damage to one of the two parts which are connected together.

In the case of the cylinder cap illustrated in FIG. 1 on the left as well the cylinder cad 5 functions as a connecting fitting for the cylinder barrel 3, that is to say the outer tube 24 thereof consisting of synthetic resin. However in this case there is a welded joint 35 or in fact a friction welded joint. Once again the cylinder barrel 3 is attached by insertion of the corresponding axial end part 36 into a sleeve-shaped extension 29′ on the cylinder cap 5, it furthermore being able to fit additionally into an annular axial depression 37 in the cap part, which adjoins the extension 29′. The end of the outer tube 24 is in this case preferably chamfered to produce a frusto-conical circumferential surface 38 in abutment with a complementary oblique surface 39 on the floor of the axial depression 37. Owing to the encircling oblique outer edge outer of the outer tube 24 is practically interrupted and the result is a contact area which is larger than simply an end-to-end contact. This is significant for a welding operation, since the friction weld connection 35 in the contact area is present between the end surface 38 and the oblique surface 39.

While in the case of a detente connection 28 it can be convenient to provide a seal 40, which is more particularly arranged axially between the cylinder barrel 3 and the cylinder cap 4, in the case of a weld such a measure is unnecessary.

In the case of the housing 2′ of FIG. 2 as well no seal is necessary between the cylinder barrel 3 and the cylinder cap 5′. In this case one cylinder cap 5′ and the synthetic resin tube 27 constitute an integral sub-assembly since more particularly in a synthetic resin molding operation they are produced as an integral component. The internal fitting of the metal tube 26 may in this case be performed in the same manner as explained in connection with FIG. 1.

More particularly in cases in which it is intended to detect the position of the piston without making contact, the metal tube 26 should be manufactured of a non-magnetizable and non-magnetic material, as applies for example for stainless steel as utilized in the present case. In connection with detection it is furthermore an advantage to design the cylinder barrel 3 with a configuration using the principles as shown in FIG. 3 as a modification of the invention. In accordance with FIG. 3 on the outer periphery, that is to say at the outer peripheral surface 41 of the outer tube 24 there is an attachment groove 42 extending parallel to the longitudinal axis 18 of the housing, such groove being integral with the outer tube 24 and serving for the detachable connection of a sensor 43 shown in broken lines. The attachment groove 42 is in the example set in a rib-shaped projection 44 on the tube which stands radially proud of the parts of the outer surface 41 which are adjacent to it. The attachment groove 42 is in the form of a dove-tail groove, but it may have a different cross section, as for instance in the form of a letter T. The axial length of the attachment groove 42 and of any projection 44 on the tube present may be the same as that of the outer tube 24 or it may be so matched to suit the overall configuration of the housing that it only extends as far as the beginning of any cylinder caps 4 and 5 arranged on the extensions 29 and 29′. It will be clear that further parallel attachment grooves can be provided arranged around the periphery of the outer tube 24. If the thickness of the wall of the outer tube 24 is sufficient, it is possible for the attachment groove 42 to be set directly in the wall of the outer tube 24 without any additional radial projection.

When producing an attachment groove 42 and/or when forming any projection 44 on the tube in or, respectively, on the outer tube 24 irregularities may be produced in the inner surface 45 of the outer tube 24 in the part, which is radially inwardly opposite to the attachment groove 42 or, respectively, the projection 44 on the tube, such irregularities being indicated shown in broken lines at 46. In the case of a design in which the piston runs directly on the tube such irregularities would entail a functional disturbance owing to the departure from the circular form. In the present case this is not the case, because the metal tube 26 is arranged in between, which means that the irregularity 46 does not affect the inner surface 25.

As furthermore shown in FIGS. 1 and 2 at one of the cylinder caps 5 and 5′ at least there is furthermore an attachment portion 47 which is formed integrally, which renders possible mounting of the housing 2 when it is required on a component provided therefor. In the case of FIG. 2 the result is a single-piece design of the outer tube 24, the cylinder cap 5′ and the attachment part 47, something which in the case of a small number of component simplifies manufacture. The attachment part is for example in the form of means having an opening and/or a male screw thread.

Manufacture using synthetic resin materials regularly involves large dimensional inaccuracies and in the case of a cylinder tube with a nominal diameter of 40 mm they amount to approximately ±0.3 min.

Such inaccuracies are prevented in the case of the use in accordance with the invention of an additional metal tube 26 without any difficulty, since the outer tube 24 consists of synthetic resin material, this meaning there is much freedom as regards the design of the outer tube without any disadvantageous effects on the accuracy of guiding as regards the piston 7.

In the case of FIGS. 2 and 3 the same reference characters are employed as in FIG. 1 to denote corresponding parts.

I claim:

1. Pneumatically operated piston and cylinder unit, having a housing (2), comprising a cylinder barrel (3) and a cylinder cap (4, 5) on both ends thereof, a piston (7) arranged within the cylinder barrel (3) for axial movement therein, a piston rod (8) mounted on said piston (7) and extending through at least one of said cylinder caps (4, 5,) said cylinder caps (4, 5) being provided each with a port (16, 17) for supply and removal of pneumatic fluid power medium for reciprocation of the piston (7), said cylinder barrel (3) consisting of an inner tube (23) of metal material and an outer tube (24) of non-reinforced synthetic resin material, said outer tube (24) coaxially encircling said inner tube (23) and said outer tube and inner tube being in direct radial contact with each other and fixed with each other by a pressfit, said inner tube (23) consisting of a non-magnetic material, at least one radially proud rib-shaped projection (44) being provided at the outer surface (41) of the outer tube (24), said projection being integral with the outer tube (24) and consisting of the same synthetic resin material as the outer tube (24) and having an attachment groove (42) for detachable attachment of a sensor (43) able to detect a position of the piston and extending parallel to the longitudinal axis (18) of the housing, said cylinder caps (4, 5) both consisting of non-reinforced synthetic material and being connected with the outer tube (24) of the housing.

2. The piston and cylinder unit according to claim 1, wherein the outer tube consists of polyvinyl chloride.

3. The piston and cylinder unit according to claim 1, wherein the outer tube consists of polyacetal.

4. The piston and cylinder unit according to claim 1, wherein the outer tube consists of polyoxymethylene.

5. The piston and cylinder unit according to claim 1, wherein the inner tube consists of stainless steel.

6. The piston and cylinder unit according to claim 1, wherein the outer tube consisting of synthetic resin material is an extruded component.

7. The piston and cylinder unit according to claim 1, wherein the inner tube consisting of metal is an extruded component.

8. The piston and cylinder unit according to claim 7, wherein the outer tube consisting of synthetic resin material is an extruded component, said cylinder barrel consisting of coaxially co-extruded inner and outer tubes.

9. The piston and cylinder unit according to claim 1, wherein the cylinder barrel and at least one of the cylinder caps are permanently connected with each other.

10. The piston and cylinder unit according to claim 9, wherein the cylinder cap and the cylinder barrel are connected by means of one of a snap-on and a detente joint.

11. The piston and cylinder unit according to claim 9, wherein the cylinder cap and the cylinder barrel are connected by means of a friction weld.

12. The piston and cylinder unit according to claim 9, wherein the cylinder cap and the cylinder barrel are connected by means of integral molding.

13. The piston and cylinder unit according to claim 1, wherein at least one cylinder cap has an attachment portion, which is integrally molded, for the external attachment of the housing.

* * * * *